US010935311B2

(12) United States Patent
Dai et al.

(10) Patent No.: US 10,935,311 B2
(45) Date of Patent: Mar. 2, 2021

(54) DOMESTIC REFRIGERATION APPLIANCE CONTAINING A COVER FOR A GAP BETWEEN A FOAM CROSSMEMBER AND AN ELECTRONICS BOX

(71) Applicant: BSH HAUSGERAETE GMBH, Munich (DE)

(72) Inventors: Yun Dai, Elchingen (DE); Andreas Lindel, Heidenheim (DE); Michael Krapp, Nattheim (DE)

(73) Assignee: BSH Hausgeraete GmbH, Munich (DE)

( * ) Notice: Subject to any disclaimer, the term of this patent is extended or adjusted under 35 U.S.C. 154(b) by 266 days.

(21) Appl. No.: 16/145,522

(22) Filed: Sep. 28, 2018

(65) Prior Publication Data

US 2019/0107323 A1 Apr. 11, 2019

(30) Foreign Application Priority Data

Oct. 5, 2017 (DE) ..... DE102017217673 .3

(51) Int. Cl.
*F25D 29/00* (2006.01)
*F25D 23/00* (2006.01)
*F25D 23/06* (2006.01)

(52) U.S. Cl.
CPC ..... *F25D 29/005* (2013.01); *F25D 23/006* (2013.01); *F25D 23/065* (2013.01); *F25D 2201/126* (2013.01)

(58) Field of Classification Search
CPC .... F25D 29/005; F25D 23/006; F25D 23/065; F25D 2201/126; F25D 2400/40
USPC ..... 312/406
See application file for complete search history.

(56) References Cited

U.S. PATENT DOCUMENTS 4,180,297 A * 12/1979 Abrams ..... F25D 23/065 16/2.2
4,920,696 A * 5/1990 Mawby ..... F25D 23/006 248/674
5,000,010 A * 3/1991 Powell ..... F25D 21/04 312/401
5,248,196 A * 9/1993 Lynn ..... F25D 23/065 264/276

(Continued)

FOREIGN PATENT DOCUMENTS

CN 102452522 A 5/2012
CN 103392105 A 11/2013

(Continued)

*Primary Examiner* — Daniel J Troy
*Assistant Examiner* — Timothy M Ayres
(74) *Attorney, Agent, or Firm* — Laurence A. Greenberg; Werner H. Sterner; Ralph E. Locher

(57) ABSTRACT

A domestic refrigeration appliance contains a housing in which a receiving space for food is configured, a machinery compartment, and an electronics box which is arranged above the machinery compartment in the housing. The machinery compartment is separated in the upward direction by a foam cross-member from an intermediate space of the housing filled with a thermally insulating material at least in regions. A gap is formed between the foam cross-member, a cover and an interior of the electronics box. A cover element is arranged in the gap such that a flow of media is blocked from the machinery compartment into the interior of the electronics box.

14 Claims, 7 Drawing Sheets

(56) References Cited

U.S. PATENT DOCUMENTS

| | | | | |
|---|---|---|---|---|
| 7,520,758 | B2 * | 4/2009 | Kim | F25D 29/005 439/76.1 |
| 8,020,400 | B2 * | 9/2011 | Neumann | F25D 23/063 62/298 |
| 8,575,497 | B2 * | 11/2013 | Hultgreen | F25D 29/005 174/502 |
| 9,810,474 | B2 * | 11/2017 | Fernandez | F25D 23/006 |
| 2007/0125119 | A1 * | 6/2007 | Naemura | F25D 23/006 62/440 |
| 2009/0079315 | A1 * | 3/2009 | Ishihara | B60P 3/20 312/401 |
| 2016/0305704 | A1 * | 10/2016 | Fahnle | F25D 23/00 |
| 2020/0033049 | A1 * | 1/2020 | Dherde | H02G 15/013 |

FOREIGN PATENT DOCUMENTS

| | | | |
|---|---|---|---|
| CN | 104279807 | A | 1/2015 |
| DE | 102009002041 | A1 | 10/2010 |
| DE | 102010040251 | A1 | 3/2012 |
| DE | 102013209747 | A1 | 11/2014 |
| DE | 102013211470 | A1 | 12/2014 |
| DE | 102013225651 | A1 | 6/2015 |

* cited by examiner

DOMESTIC REFRIGERATION APPLIANCE CONTAINING A COVER FOR A GAP BETWEEN A FOAM CROSSMEMBER AND AN ELECTRONICS BOX

CROSS-REFERENCE TO RELATED APPLICATION

This application claims the priority, under 35 U.S.C. § 119, of German application DE 10 2017 217 673.3, filed Oct. 5, 2017; the prior application is herewith incorporated by reference in its entirety.

BACKGROUND OF THE INVENTION

Field of the Invention

The invention relates to a domestic refrigeration appliance containing a housing in which a receiving space for food is configured. The domestic refrigeration appliance further contains a machinery compartment. An electronics box of the domestic refrigeration appliance, viewed in the height direction of the domestic refrigeration appliance, is arranged above the machinery compartment in the housing.

In modern domestic refrigeration appliances, multifunctionality is an essential feature. These different functions, however, require a plurality of lines so as to permit connections between electronic components or other components in order to be able to exchange electrical signals or other media. In this connection, a plurality of sensors is installed in modern domestic refrigeration appliances. Cameras may also be present. In particular, the refrigeration circuit also contains components, such as for example a compressor, which have to be correspondingly supplied with electrical energy and also have to be controlled by control signals. In addition, the energy efficiency of such a domestic refrigeration appliance is always a priority.

A plurality of control devices of the domestic refrigeration appliance requires constructional space. In addition, therefore, the thermally insulating function of the domestic refrigeration appliance is not intended to be impaired.

A refrigeration appliance having an electronics housing which is arranged in the housing of the domestic refrigeration appliance is disclosed in published, non-prosecuted German patent application DE 10 2013 209 747 A1. This electronics housing is arranged above a machinery compartment. Therefore, in this case a plurality of lines has to be laid between the electronics box and the components in the machinery compartment. The interface at the transition, in particular, with the machinery compartment is thus relatively critical, on the one hand, in order to be able to lay the plurality of lines safely and on the shortest path and, on the other hand, not to impair the thermally insulating effect.

A refrigeration appliance is disclosed in published, non-prosecuted German patent application DE 10 2013 211 470 A1 in which a machinery compartment is defined by such a foam cross-member. Accordingly, a refrigeration appliance is disclosed in published, non-prosecuted German patent application DE 10 2010 040 251 A1 in which a foam cross-member which defines a machinery compartment is also present. Evaporation chambers are integrated in this foam cross-member.

Moreover, a domestic refrigeration appliance is disclosed in published, non-prosecuted German patent application DE 10 2013 225 651 A1 in which a fan housing is mounted on a cross bar in a machinery compartment.

It is also known that humid air is produced in the machinery compartment, the humid air rising upwardly and potentially being dispersed relative thereto. If corresponding lines are guided in the region of a foam cross-member from the machinery compartment to the electronics box, due to leakage this humid air may even enter the electronics box and penetrate therein. This may lead to a condensation problem which possibly may also impair the functionality of the electronics.

SUMMARY OF THE INVENTION

It is the object of the present invention to provide a domestic refrigeration appliance in which such a condensation problem is avoided.

This object is achieved by a domestic refrigeration appliance which contains the features of the main claim.

One feature of the invention relates to a domestic refrigeration appliance containing a housing in which a receiving space for food is configured. The domestic refrigeration appliance also contains a machinery compartment. The domestic refrigeration appliance also contains at least one electronics box which is arranged in the height direction of the domestic refrigeration appliance above the machinery compartment and is arranged in the housing of the domestic refrigeration appliance. The machinery compartment is separated in the upward direction by a foam cross-member, which constitutes a separate physical component, from a thermally insulating region of the housing. Viewed in the depth direction of the domestic refrigeration appliance to the rear and thus on the rear face, the machinery compartment may be covered by a rear wall which constitutes a cover. A gap is formed between the foam cross-member and an interior of the electronics box. If a separate cover of the machinery compartment is provided, the gap is formed between the foam cross-member, this separate cover and the interior of the electronics box. A separate cover element is arranged in this gap such that a flow of media is blocked from the machinery compartment into the interior of the electronics box. Thus by such a separate additional functional component, represented by this cover element, the installation of the previous components may take place unchanged but humid air from the machinery compartment is prevented from entering via the gap into the electronics box. The formation of condensation in the electronics box and thus an impairment to the function of the electronics is avoided thereby.

Advantageously, this cover element is a strip. As a result, the cover element is configured to be very space-saving and suitable for the requirements for sufficiently covering the gap. As a result, viewed over the width of the domestic refrigeration appliance, it is possible for the gap to be covered over a surface area which is as large as possible in the peripheral direction.

Preferably, it is provided that the cover element is configured integrally from plastics material. An embodiment which is mechanically stable, with a reduced number of components and reduced weight is possible as a result.

Preferably, it is provided that the cover element is configured as a line receiving part for lines which are laid between the machinery compartment and the electronics box or which are laid between the electronics boxes. By means of such an embodiment, the cover element is a multifunction component. Thus the lines may be laid so as to be aligned and received in a positionally stable manner. If the cover element is configured as a line receiving part for lines which are laid between the electronics boxes, the required constructional space for electronic components may be advantageously divided between two, three or more electronics boxes. Thus, on the one hand, the weakening of the insulation which is inevitably caused by the electronics box may be reduced in its effect by a spatial distribution of the electronics boxes. On the other hand, the two, three or more electronics boxes may be positioned where they are best able to be arranged for their respective purpose (for example short line paths for components located outside the electronics boxes). The cover element in turn permits a secure guidance of the lines between the two, three or more electronics boxes, so as to be protected against the entry of the flow of media. The two, three or more electronics boxes comprise, for example, in each case a base body and a lid substantially closing this base body, for example except for a gap.

Preferably, it is provided that the cover element contains at least one wall in which at least one line slot is configured for guiding through a line. The laying of the lines on the cover element, on the one hand, and the positionally secure retention of the lines, on the other hand, are advantageously permitted thereby. By the design of a slot the mounting of the lines is also possible in a particularly rapid and targeted manner. As a result, threading through a hole which is fully closed on the periphery, which is a complex procedure, is not required.

Preferably, it is provided that the cover element comprises at least one wall, at least one line clip being configured thereon for receiving a line. At least one line, therefore, may be laid so as to bear there against and is also individually accessible. The at least one line clip is integrally formed on an outer face of a bottom wall and/or a bottom limb of the cover element, so that the accessibility to this line clip may take place in a particularly simple and user-friendly manner. The mounting and dismantling and thus the specific laying of lines is thus simplified.

It may be provided that a line outlet of the foam cross-member remote from the cover element is covered by a separate sealing element which comprises a line feed-through. This is a further very advantageous embodiment since a separate sealing element is thus present on the foam side, which prevents the penetration of insulating foam as far as the cover element and in addition permits lines to be guided through.

In an advantageous embodiment, the sealing element is made of foam material. As a result, the sealing element is particularly elastically deformable and permits, in particular, a positionally accurate arrangement. On the other hand, by means of this embodiment the penetration of insulating foam is prevented in a particularly advantageous manner. On the other hand, the foam is also a very lightweight material so that here weight may be correspondingly saved.

In particular, the cover element is configured as an elongated L-shaped profile. As a result, in the installed state, a particularly space-saving embodiment is possible. The mechanically stable positioning is also able to be achieved in a very advantageous manner.

In particular, it is provided that the aforementioned wall, on which a line slot and/or a line clip are formed, is the bottom limb of the L-shape.

Advantageously, the bottom limb of the L-shape, viewed in the depth direction of the domestic refrigeration appliance, is arranged so as to overlap with the foam cross-member and this bottom limb engages below the foam cross-member. In this connection, therefore, the foam cross-member is supported from below by the bottom limb. The foam cross-member thus bears against this bottom limb of the cover element.

In an advantageous embodiment, the cover element is releasably arranged on the foam cross-member in a non-destructive manner. As a result, the mounting and dismantling may take place in a manner which is reversible and able to be repeatedly implemented.

In an advantageous embodiment, it is provided that the cover element is latched to the foam cross-member. Such a connection which is releasable in a non-destructive manner is able to be produced in a simple and rapid manner and is releasable again. A positionally secure and mechanically stable connection is nevertheless produced.

In particular, it is provided that in the assembled state the cover element and the foam cross-member form a cavity which is a line duct for laying lines. Thus, in the assembled state a channel is also produced by means of these two components, the channel being closed on the periphery at least in regions, viewed in the direction of its longitudinal axis. Lines are thereby prevented from falling out. On the other hand, the lines are arranged so as to be particularly protected such that effect of mechanical forces may also be avoided, such as the penetration of other media on the periphery, such as moisture or the like.

Preferably, it is provided that the cover element is arranged in the height direction of the domestic refrigeration appliance so as to overlap with a housing part of the electronics box and an edge projection of the cover element bears on the outer face against an edge projection of this housing part. Moreover, by this specification a mutual support and thus a mechanically stable positioning of the aforementioned components is possible, and in addition the penetration of media is prevented at this interface.

Preferably, it is provided that the machinery compartment is covered by a cover on the rear face. In particular, the cover may fully or substantially fully prevent viewing into the machinery compartment and/or intervention in the machinery compartment.

Lines may be, in particular, electrical cables. These cables may be guided to at least one solenoid valve, which is installed in the machinery compartment, and/or a compressor. Moreover, other components in the machinery compartment which require electrical signals may be connected to corresponding cables. The electronics, such as for example a control device, may be arranged in the aforementioned electronics box to which these cables lead. In order to be able to guide the cables into the electronics box, an opening is required in the housing of the electronics box which, as mentioned above, then provides the possibility of humid air from the machinery compartment being able to enter the interior of the electronics box. By means of the aforementioned embodiments, this is now prevented by a specific component, namely this separate cover element, being present.

The positions and orientations are specified by the terms "above", "below", "front", "rear", "horizontal", vertical", "depth direction", "width direction", "height direction", etc. which are provided when the device and/or the appliance are used as intended and arranged as intended and when an observer is standing in front of the appliance and is looking in the direction of the appliance.

Further features of the invention are disclosed from the claims, the figures and the description of the figures. The features and combinations of features cited above in the description and the features and combinations of features cited hereinafter in the description of the figures and/or shown individually in the figures are not only able to be used in the respectively specified combination but also in other combinations without departing from the scope of the invention. Thus embodiments of the invention which are not explicitly shown and described in the figures but which are disclosed and may be produced by separate combinations of features from the described embodiments are also to be regarded as encompassed and disclosed. Embodiments and combinations of features which thus do not comprise all of the features of an originally formulated independent claim are thus also to be regarded as disclosed. Moreover, embodiments and combinations of features which go beyond or deviate from the combinations of features set forth in the references of the claims are to be regarded as disclosed, in particular, by the embodiments set forth above.

Other features which are considered as characteristic for the invention are set forth in the appended claims.

Although the invention is illustrated and described herein as embodied in a domestic refrigeration appliance comprising a cover for a gap between a foam cross-member and an electronics box, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
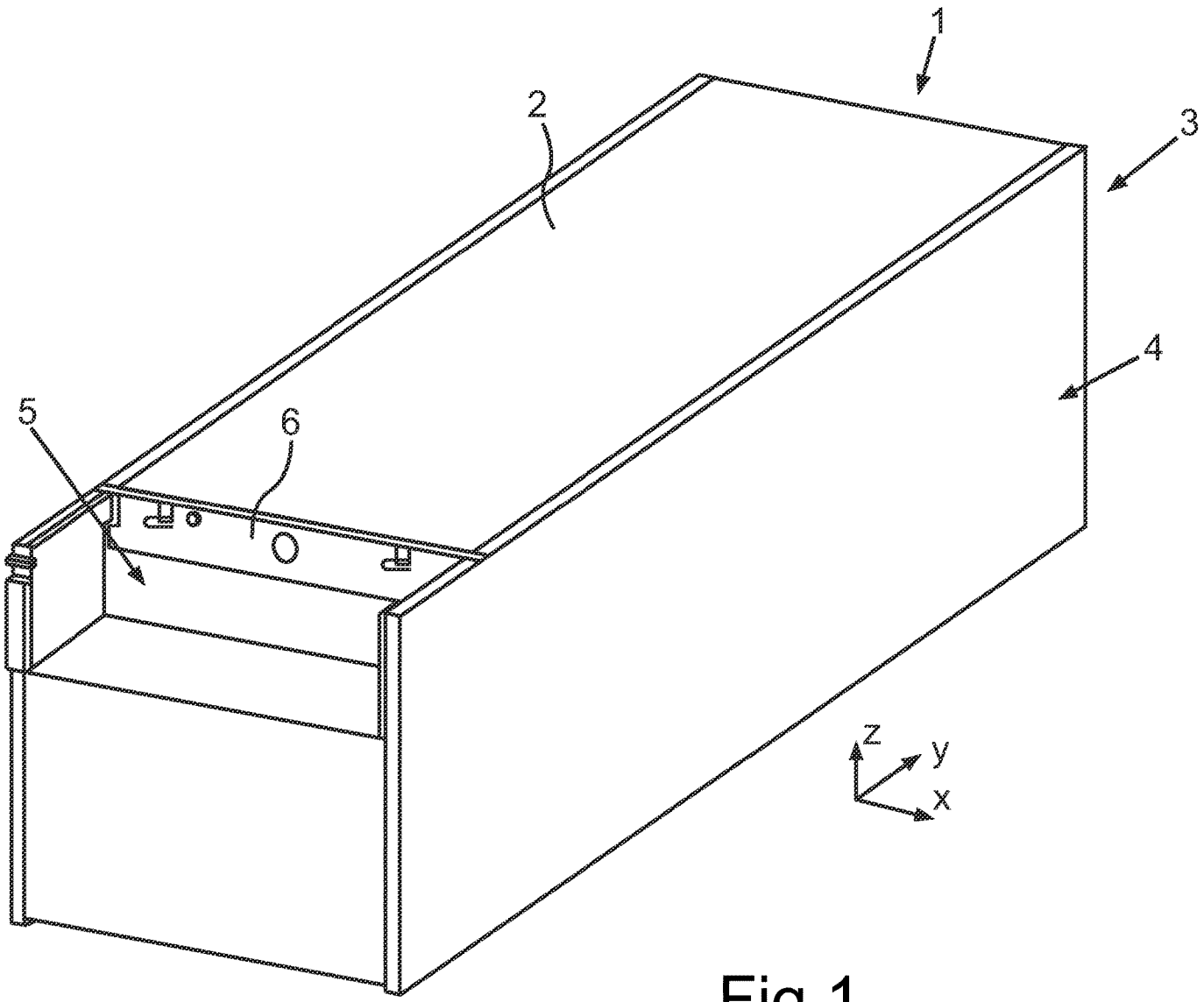
FIG. 1 is a diagrammatic, perspective view of an exemplary embodiment of a domestic refrigeration appliance according to the invention.

Elements which are the same or functionally the same are provided in the figures with the same reference characters.

Referring now to the figures of the drawings in detail and first, particularly to FIG. 1 thereof, there is shown sn exemplary embodiment of a domestic refrigeration appliance 1 which may be a refrigerator or a freezer or a combi-fridge-freezer is shown. The domestic refrigeration appliance 1 is shown here in a perspective view of a rear face 2. The domestic refrigeration appliance 1 has a housing 3 which contains side walls and also at least the rear wall 2. Viewed in the height direction (y-direction), the domestic refrigeration appliance 1 in the lower region contains a machinery compartment 5 which, viewed in the depth direction (z-direction), is configured so as to be located to the rear. The housing 3 contains an outer housing which has side walls 4 and the rear wall 2 and a top wall, not shown. Moreover, the housing 3 has a separate internal container which with its walls defines a receiving space for food. The receiving space may be a refrigerating compartment or a freezer compartment. Thermally insulating material, for example insulating foam, is introduced into an intermediate space between the outer housing and the internal container. The machinery compartment 5 is defined in the upward direction by a foam cross-member 6, as shown in FIG. 1, and separated from this intermediate space and thus also from this insulating material. The foam cross-member 6 is a component oriented in the width direction (x-direction) which is configured, in particular, in the manner of a bar. A plurality of components of the domestic refrigeration appliance 1 may be arranged in the machinery compartment 5. For example, a compressor 7 (FIG. 3) may be arranged here. Other components, such as for example a condensate collection tray or at least one solenoid valve, may also be arranged here.

Figure 2:
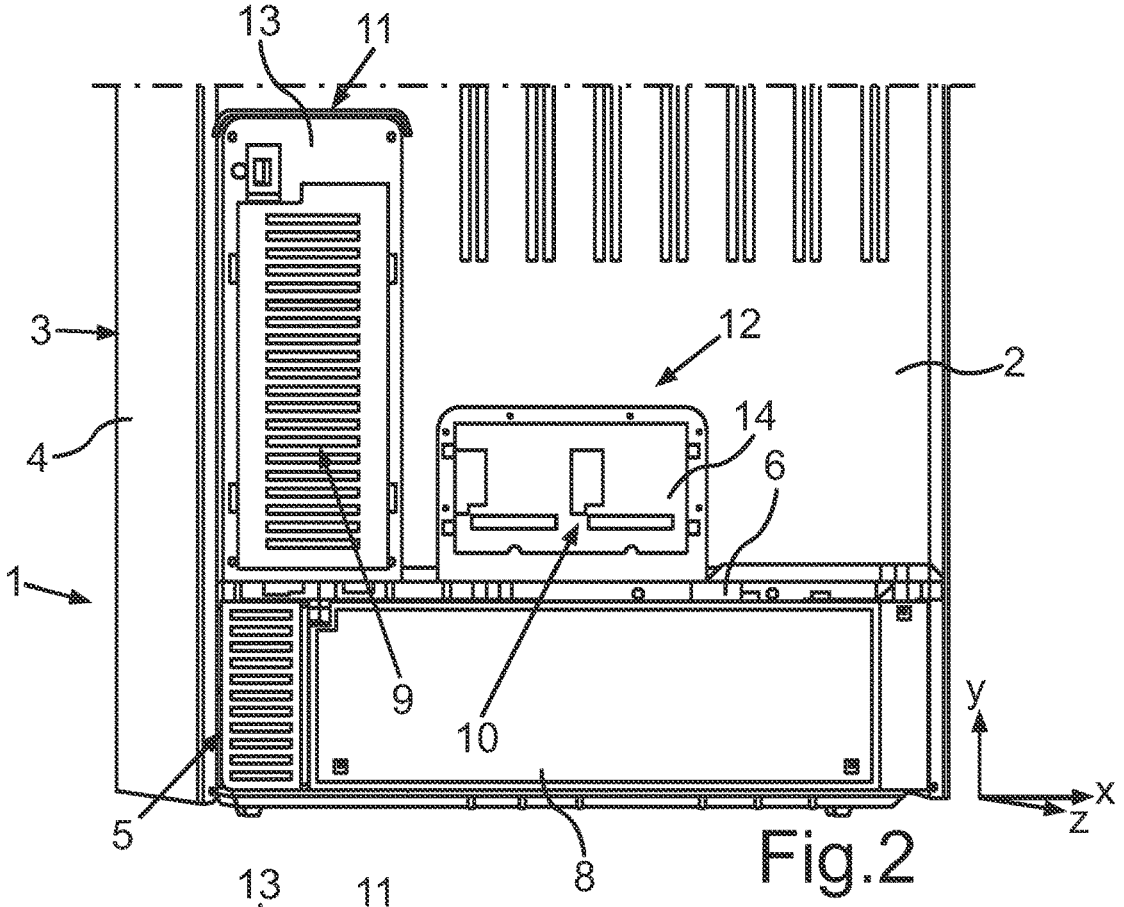
FIG. 2 is a perspective partial view of the domestic refrigeration appliance according to FIG. 1 with a view of a rear face of the domestic refrigeration appliance.

In FIG. 2 the domestic refrigeration appliance 1 is shown in a perspective view in this lower region in which the machinery compartment 5 is also located. As may be identified here, the machinery compartment 5 on the rear face, and thus viewed in the depth direction, is covered to the rear by a separate cover 8. The cover 8, therefore, constitutes a rear wall by which the machinery compartment 5 is closed.

Moreover, the domestic refrigeration appliance 1 contains at least one electronics box 9 which is arranged in the housing 3. In the exemplary embodiment, a first electronics box 9 and a second electronics box 10 are provided, said second electronics box also being arranged in the housing 3. The two separate electronics boxes 9 and 10 in each case are configured with a housing 11 and 12. In the embodiment shown, it is provided that a housing part 13 of the housing 11 forms a rear cover of the electronics box 9.

Moreover, a housing part 14, which constitutes a cover of the electronics box 10 on the rear face and thus is a housing part of the housing 12, is shown. As may be identified here, the electronics boxes 9, 10, viewed in the height direction, are arranged above the machinery compartment 5 and thus also above the cover 8 at least in regions.

In order to be able to guide lines, in particular electrical cables, out of the electronics box 9 and/or 10, the housings 11 and 12 comprise corresponding outlets and/or openings. If such lines have to be guided downwardly into the machinery compartment 5, such openings also face this machinery compartment 5.

Figure 3:
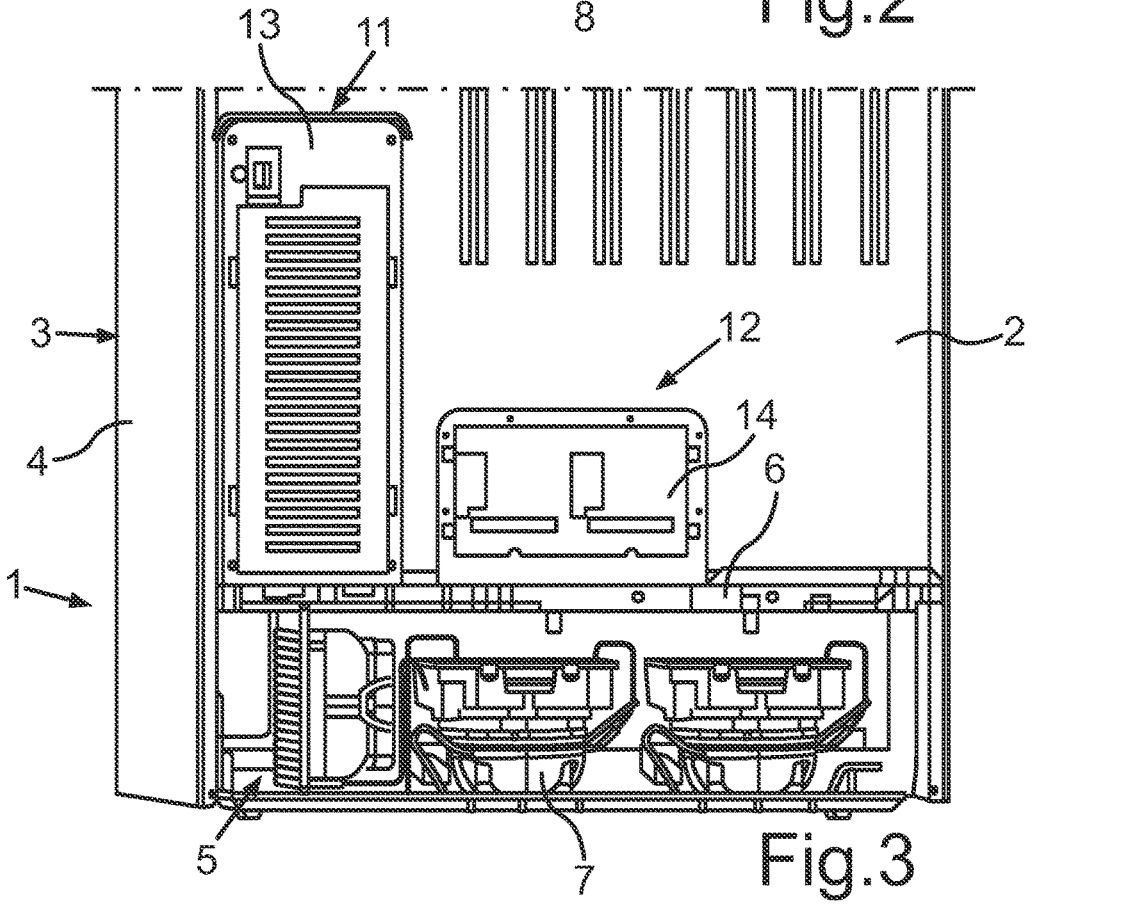
FIG. 3 is a perspective partial view according to FIG. 2 with the cover of the machinery compartment removed.
Figure 5:
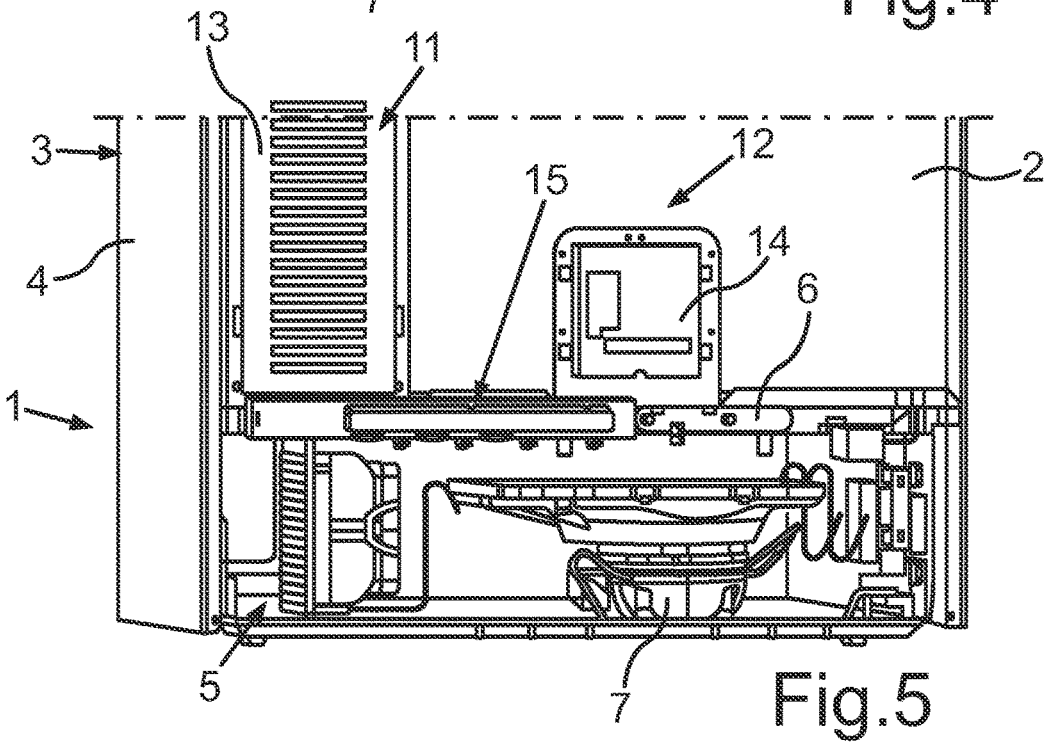
FIG. 5 is a perspective view according to FIG. 3 but with the cover element already mounted.

In FIG. 3 the view of the domestic refrigeration appliance 1 according to FIG. 2 is shown but with the cover 8 removed and a separate cover element 15 associated with the domestic refrigeration appliance 1 removed (FIG. 5). In the view in FIG. 3, therefore, it is possible to look into the machinery compartment 5 and the foam cross-member 6 may be identified.

Figure 4:
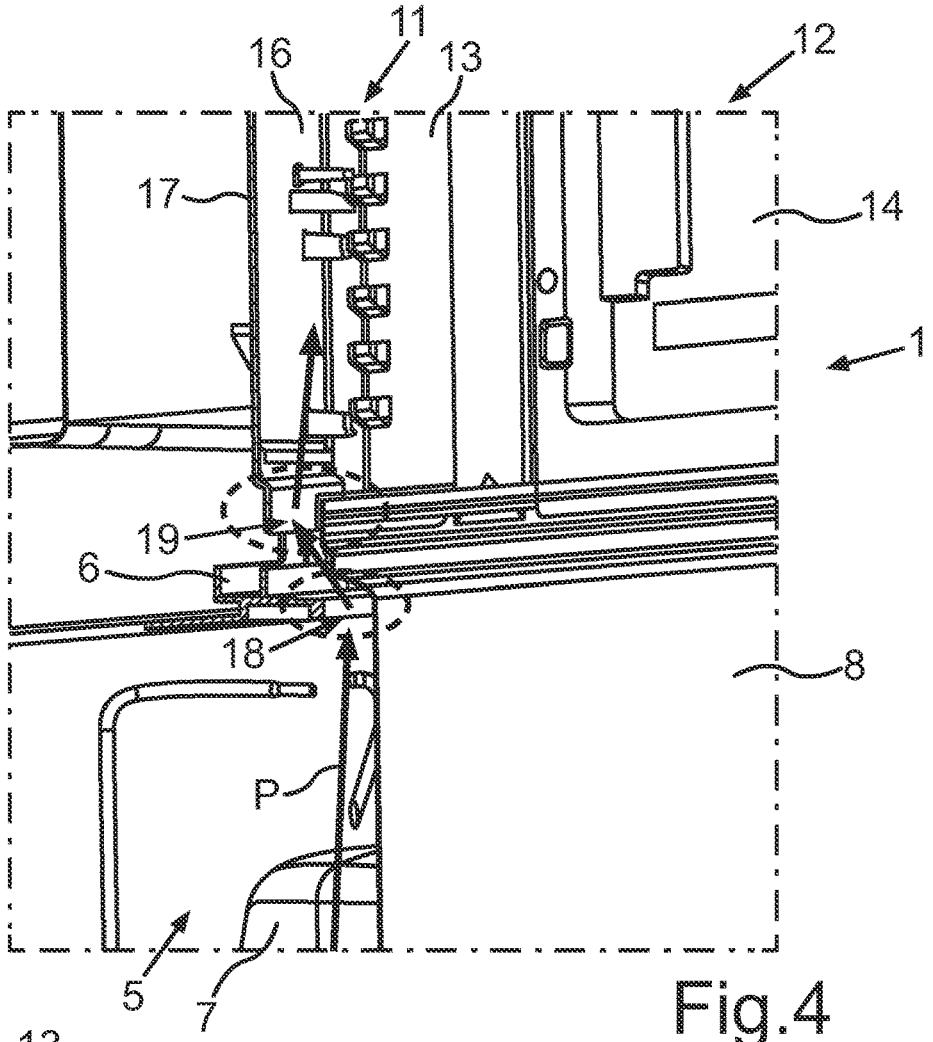
FIG. 4 is an enlarged perspective sectional view of a partial region in FIG. 3.

In FIG. 4 the domestic refrigeration appliance 1 according to the components in FIG. 2 is shown in a perspective sectional view. The vertical section (the cutting plane is the y-z plane) is in this case able to be identified in the region of the electronics box 9. The electronics box 9 contains an interior 16 in which electronic components, such as for example a control device, may be arranged. In FIG. 4 a further housing part 17 of the housing 11 which constitutes a front wall of the housing 11 may also be identified. The housing 11 is formed by the two separate housing parts 13 and 17. As may be identified, a gap 18 is formed between the foam cross-member 6 and the cover 8 so that humid air P may pass through this gap 18 from the machinery compartment 5. Moreover, an opening 19 is also configured in the housing 11, the opening facing the machinery compartment 5 and lines being guided through the opening into the interior 16 and/or out of the interior 16. The gap 18 thus extends as far as the opening 19. By this separate cover element 15 already cited above, which is not shown in FIG. 4, this gap 18 is covered toward the interior 16. To this end, in FIG. 5 the perspective view from the rear is shown, in which this cover element 15 is mounted. The gap 18 is thus closed by this cover element 15 such that the humid air P may not enter the interior 16.

Figure 6:
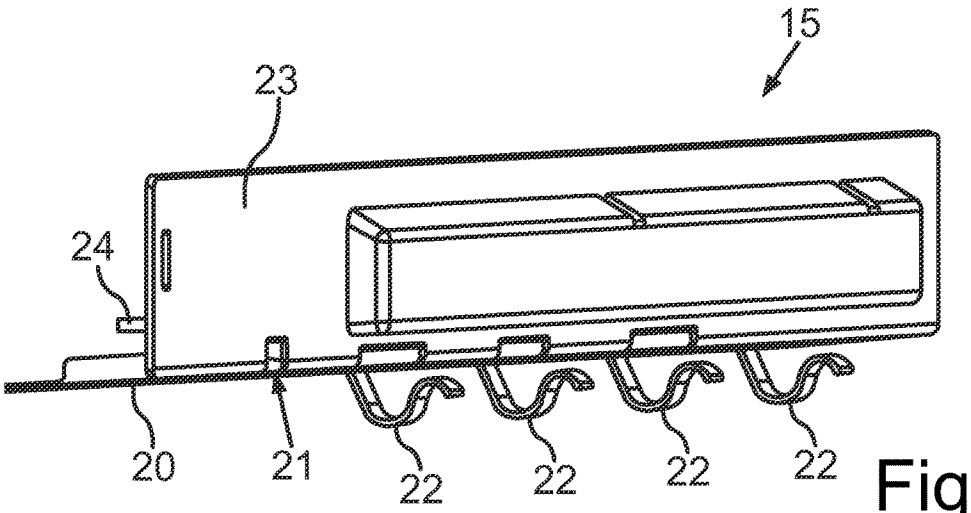
FIG. 6 is a perspective view of an exemplary embodiment of an aforementioned cover element.
Figure 7:
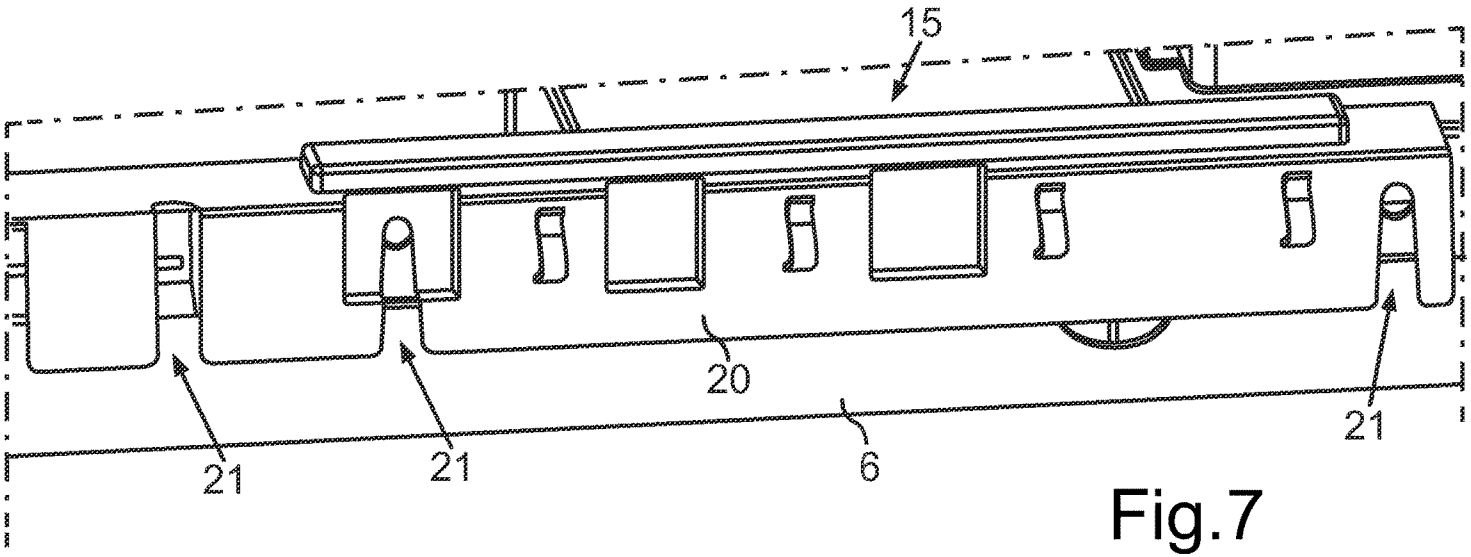
FIG. 7 is a perspective view from below of a partial region of the view of FIG. 5.

In FIG. 6 a perspective view of an exemplary embodiment of this cover element 15 is shown. The cover element is configured, in particular, integrally. The cover element is preferably made from plastics material. The cover element 15 is preferably configured as a strip and has, in particular, an L-shape. The L-shape contains a bottom limb 20. Here in the exemplary embodiment a plurality of line slots 21 are configured on this bottom limb 20. Moreover, line clips 22 are integrally formed on a lower outer face of this bottom limb 20. These line clips 22 are configured for externally supporting and/or receiving lines, in particular electrical cables. Electrical cables may be easily threaded and guided through the line slots 21 and thus guided from the machinery compartment 5 into a cavity which is formed between the foam cross-member 6 and the cover element 15. In FIG. 7 it may be identified how the foam cross-member 6 is engaged from below by the cover element 15 and thus is concealed relative thereto. As a result, the gap 18 is also covered in a defined manner. By means of a vertical limb 23 of the L-shape, the mechanically stable fastening to other components, in particular also the foam cross-member 6, is possible. To this end, preferably latching elements 24 (FIG. 6) are provided, the cover element 15 being releasably arranged, in particular being latched, thereby on the foam cross-member 6 in a non-destructive manner.

Figure 8:
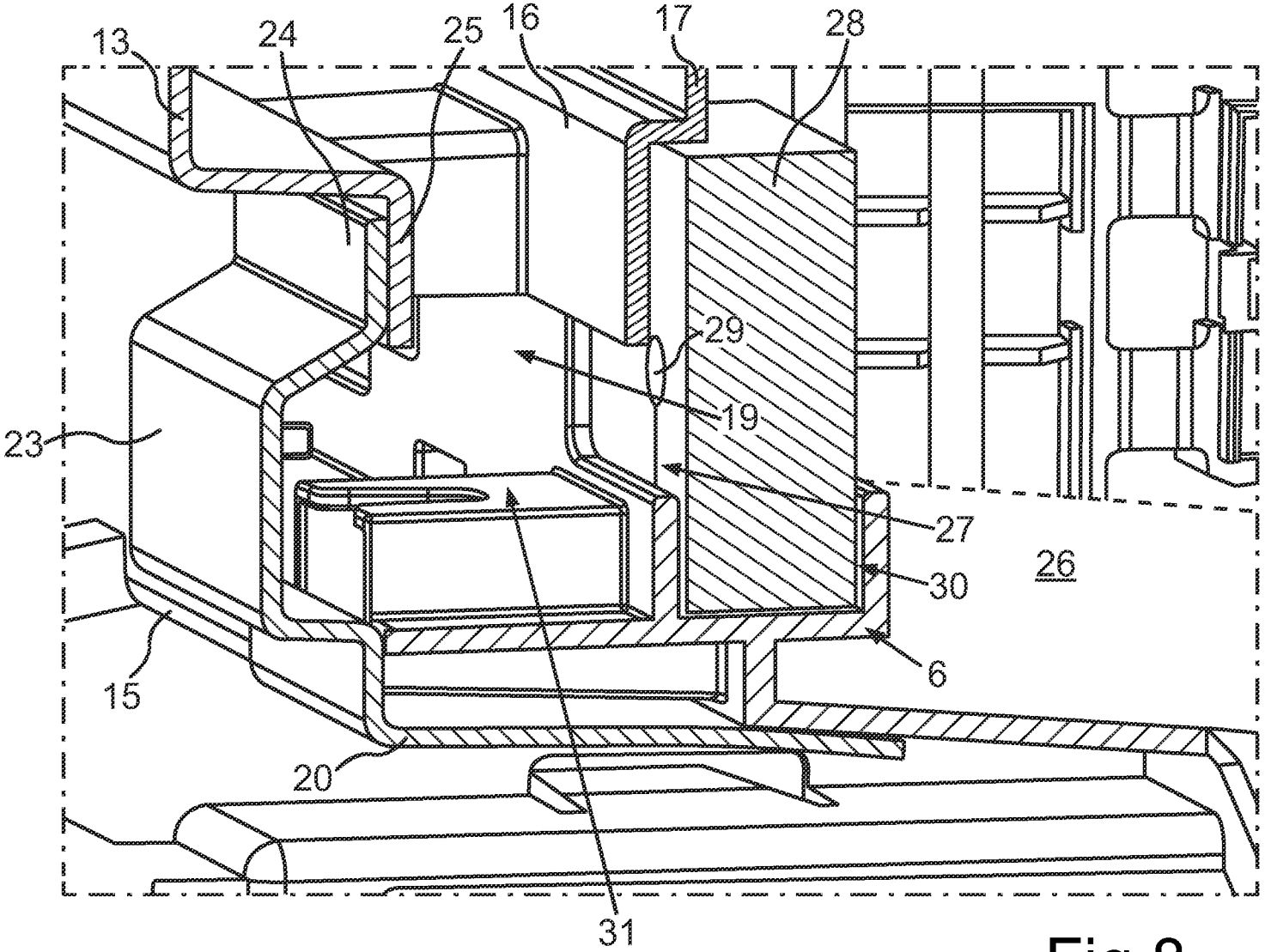
FIG. 8 is a perspective, sectional view through the domestic refrigeration appliance in the region of the foam cross-member and the cover element separate therefrom.

In FIG. 8 in a perspective sectional view the domestic refrigeration appliance 1 is shown in the region of the foam cross-member 6 and the cover element 15. As may be identified here, the cover element 15 in the height direction overlaps the housing part 13, wherein here an edge projection 35 of the cover element 15 overlaps an edge projection 25 of the housing part 13 and these edge projections 35 and 25 are arranged so as to bear flat against one another. By the latching of the cover element 15 on the foam cross-member 6 this edge projection 35 is also pressed against the edge projection 25.

The engaging of the foam cross-member 6 below a bottom limb 20 of the cover element 15 is also able to be identified in FIG. 8. For the sake of clarity, the cover 8 is not shown here.

In FIG. 8, an intermediate space 26 between the internal container and the outer housing of the domestic refrigeration appliance 1 is also shown. Since lines, such as electrical cables or media lines such as hoses or the like, may be correspondingly laid, it is provided here that a further opening 27 of the foam cross-member 6 is concealed by a separate sealing element 28, such lines from the electronics box 11 being able to be guided through the opening into this intermediate space 26. The sealing element 28 is configured here as a block. The sealing element 28 is preferably made of foam material. It contains, in particular, a feed-through 29, a line being able to be guided therethrough. As may be identified, this sealing element 28 is inserted in a groove-like receiver 30 of the foam cross-member 6 and retained relative thereto. The intermediate space 26 is filled with a thermally insulating material, in particular insulating foam, which is not yet shown. By means of the sealing element 28 this opening 27 is protected from the ingress of such insulating foam.

In FIG. 8 the cavity 31 which is formed between the foam cross-member 6 and the cover element 15 is also already shown. Lines are laid in this cavity 31.

Figure 9:
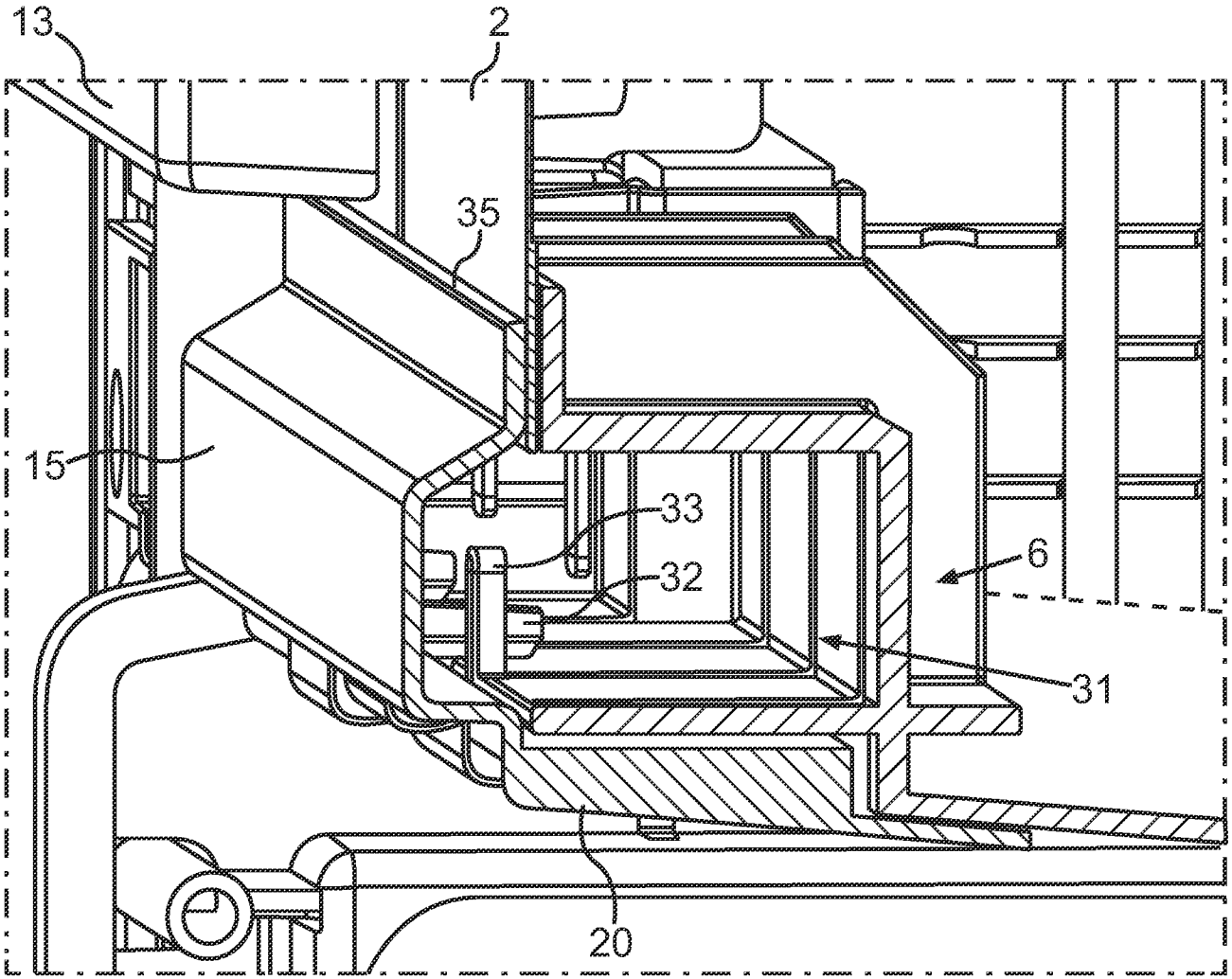
FIG. 9 is a perspective sectional view according to FIG. 8 at a point which is different from FIG. 8, viewed in the width direction of the domestic refrigeration appliance.

In FIG. 9, the view according to FIG. 8 is shown but viewed in the width direction, in section at a different point. Here the cavity 31 which constitutes a line duct may also be identified. In FIG. 9, moreover, the latching between the foam cross-member 6 and the cover element 15 is also shown. Here latching hooks 32 which extend in the depth direction of the domestic refrigeration appliance 1 are integrally formed on the cover element 15. Corresponding counter-latching elements 33 which extend in the height direction are integrally formed on the foam cross-member 6. In this case, the latching effect is thus formed, in particular, in the depth direction by the latching elements 32 snapping behind the counter-latching elements 33.

Figure 10:
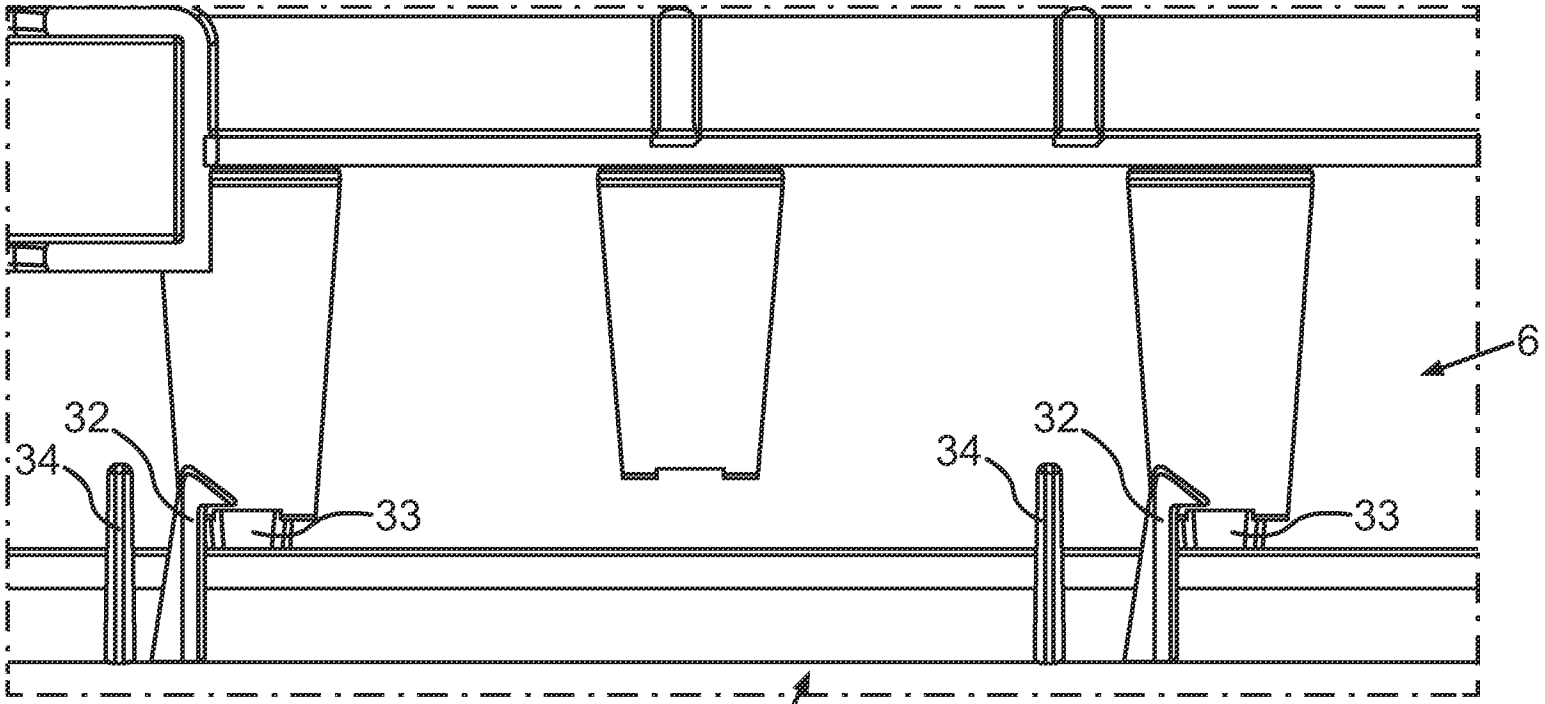
FIG. 10 is a view of a connecting device between the foam cross-member and the cover element.

In FIG. 10 a plan view from above onto these latching connections is shown. Moreover, projections 34 which serve as stops may also be identified here so that accordingly the vertical position of the cover element 15 may be adjusted and predetermined in a simple manner. In particular, these stops 34 are positioned from above on corresponding elements, in particular of the foam cross-member 6, so that the cover element 15 is prevented from slipping down.

The following is a summary list of reference numerals and the corresponding structure used in the above description of the invention:

1 Domestic refrigeration appliance
2 Rear face
3 Housing
4 Side wall
5 Machinery compartment
6 Foam crossmember
7 Compressor
8 Cover
9 Electronics box
10 Electronics box
11 Housing
12 Housing
13 Housing part
14 Housing part
15 Cover element
16 Interior
17 Housing part
18 Gap
19 Opening
20 Bottom limb
21 Line slot
22 Line clip
23 Vertical limb
24 Latching element
25 Edge projection
26 Intermediate space
27 Opening

28 Sealing element
29 Feed-through
30 Receiver
31 Cavity
32 Latching element
33 Counter-latching element
34 Projection
35 Edge projection
P Air

The invention claimed is:

1. A domestic refrigeration appliance, comprising:

a housing in which at least one receiving space for food is configured, said housing having an intermediate space filled with a thermally insulating material at least in regions;

a machinery compartment;

at least one electronics box disposed above said machinery compartment in said housing;

a foam cross-member, said machinery compartment is separated in an upward direction by said foam cross-member from said intermediate space of said housing, said foam cross-member and an interior of said electronics box defining a gap being formed there-between; and a separate cover element disposed in said gap such that a flow of media is blocked from said machinery compartment into said interior of said electronics box, said separate cover element being configured with an elongated L-shaped profile.

2. The domestic refrigeration appliance according to claim 1, wherein said separate cover element is a strip.

3. The domestic refrigeration appliance according to claim 1, wherein said separate cover element is configured integrally from plastics material.

4. The domestic refrigeration appliance according to claim 1, wherein:

said electronics box is one of a plurality of electronics boxes; and said separate cover element is configured as a line receiving part for lines which are laid between said machinery compartment and said electronics box and/or which are laid between said electronics boxes.

5. The domestic refrigeration appliance according to claim 4, wherein said separate cover element has at least one wall in which at least one line slot is formed therein for guiding through a line.

6. The domestic refrigeration appliance according to claim 4, wherein said separate cover element contains at least one wall and at least one line clip being configured thereon for receiving a line.

7. The domestic refrigeration appliance according to claim 1, further comprising a separate sealing element having a line feed-through formed therein; and wherein said foam cross-member has a line outlet formed therein remote from said separate cover element and is covered by said separate sealing element.

8. The domestic refrigeration appliance according to claim 7, wherein said separate sealing element is made of foam material.

9. The domestic refrigeration appliance according to claim 5, wherein said wall is a bottom limb of said elongated L-shaped profile.

10. The domestic refrigeration appliance according to claim 1, wherein said bottom limb of said elongated L-shaped profile, in a depth direction of the domestic refrigeration appliance, is disposed so as to overlap with said foam cross-member and engages below said foam cross-member.

11. The domestic refrigeration appliance according to claim 1, wherein said separate cover element is releasably disposed on said foam cross-member in a non-destructive manner.

12. The domestic refrigeration appliance according to claim 11, wherein said separate cover element is latched to said foam cross-member.

13. The domestic refrigeration appliance according to claim 1, wherein in an assembled state said separate cover element and said foam cross-member form a cavity which is a line duct for laying lines.

14. A domestic refrigeration appliance, comprising:

a housing in which at least one receiving space for food is configured, said housing having an intermediate space filled with a thermally insulating material at least in regions;

a machinery compartment;

at least one electronics box disposed above said machinery compartment in said housing, said at least one electronics box having a housing part with an edge projection;

a foam cross-member, said machinery compartment is separated in an upward direction by said foam cross-member from said intermediate space of said housing, said foam cross-member and an interior of said electronics box defining a gap being formed there-between;

a separate cover element disposed in said gap such that a flow of media is blocked from said machinery compartment into said interior of said electronics box, said separate cover element having an edge projection; and said separate cover element in a height direction of the domestic refrigeration appliance is disposed so as to overlap with said housing part of said electronics box and said edge projection of said separate cover element bears on an outer face against said edge projection of said housing part.

* * * * *